United States Patent [19]

Textor et al.

[11] 4,425,411

[45] Jan. 10, 1984

[54] MOLD WITH THERMALLY INSULATING, PROTECTIVE COATING

[75] Inventors: Marcus Textor, Schaffhausen; Tibor Kugler, Thayngen, both of Switzerland; Jean-Pierre Gabathuler, Vancouver, Canada

[73] Assignee: Swiss Aluminium Ltd., Chippis, Switzerland

[21] Appl. No.: 376,415

[22] Filed: May 10, 1982

[30] Foreign Application Priority Data

May 21, 1981 [CH] Switzerland ..... 3309/81

[51] Int. Cl.[3] ..... B22D 13/10

[52] U.S. Cl. ..... 428/702; 249/111; 249/134; 164/72; 164/134; 427/135; 106/38.9; 428/472

[58] Field of Search ..... 106/38.29, 38.9; 427/135; 249/111, 134, 135; 164/72, 134, 418; 428/472, 702

[56] References Cited

U.S. PATENT DOCUMENTS

| | | | |
|---|---|---|---|
| 3,773,549 | 11/1973 | Elbert et al. | 106/38.27 X |
| 4,037,015 | 7/1977 | Koike et al. | 106/38.27 X |
| 4,343,345 | 8/1982 | Brugger | 106/38.27 X |

*Primary Examiner*—George F. Lesmes
*Assistant Examiner*—Nancy A. B. Swisher
*Attorney, Agent, or Firm*—Bachman and LaPointe

[57] ABSTRACT

The mold features on its work face a thermally insulating protective layer of sub-micron metal oxide particles.

The coating can be applied by spraying an aqueous sol of a metal oxide onto the mold work face which has been heated to at least 60° C.

The use of sub-micron sized metal oxide particles enables the formation of a protective coating of very low density and consequently very low thermal conductivity. The coating can furthermore be deposited very economically, and likewise removed again.

17 Claims, No Drawings

MOLD WITH THERMALLY INSULATING, PROTECTIVE COATING

BACKGROUND OF THE INVENTION

The present invention relates to a mold, in particular a mold for casting aluminum and its alloys, the working surface of which features a thermally insulating, protective coating.

On casting metals in molds the melt is brought into direct contact with the mold in order to solidify the metal. For reasons of quality it is necessary to regulate very accurately the heat transfer during the time the melt first makes contact with the mold surface. If heat extraction is too strong, undesireable cold shuts are often observed in the cast product. Strong heat extraction through the mold at the start also produces considerable thermal stressing which can lead to thermal cracking of the mold work face.

A known method of regulating the heat transfer between melt and mold is to apply a thermally insulating, protective coating to the work face of the mold. Such coatings are made for example of ceramic materials which are applied to the mold face by high temperature spraying methods. Permanent ceramic coatings, however, yield only relatively short service lives and have high cost. Also known are thermally insulating coatings which are deposited on the mold face in the form of an aqueous suspension of fine, granular refractory material. In practice it has been found disadvantageous if the layer is not uniformly thick over the whole of the mold face as the rate of solidification at the start is also non-uniform, which can lead to flaws in the casting such as surface porosity and surface cracking. Also, commercially available coatings form on the work face of the mold a strongly adherent protective layer which has to be removed completely in a very labor intensive process before depositing a new layer.

SUMMARY OF THE INVENTION

In view of the above it is an object of the invention to develop a mold of the kind mentioned at the start bearing a protective coating which provides very good thermal insulation and which can be readily deposited uniformly over the work face of the mold and removed again from that face.

This object is achieved by way of the invention in that the protective coating comprises basically sub-micron metal oxide particles.

DETAILED DESCRIPTION

The use of sub-micron metal oxide particles to coat the work face of the mold makes it possible to build up thin layers with very low density and therefore low thermal conductivity. To achieve a specific thermal insulation, therefore, only a small quantity of metal oxide particles per unit work face area is necessary.

The mass of the protective layer of metal oxide particle material is preferably 0.002–2 mg/cm$^2$ of mold facing, and the preferred particle size is 5–50 nm.

Particularly good results with respect to thermal insulation are obtained using a protective layer made up of sub-micron $SiO_2$ particles. Other preferred metal oxides are $Al_2O_3$, MgO, $TiO_2$ and $ZrO_2$. The oxides may be employed as single oxides or in mixture form.

The coating process can be carried out simply by wetting the work face of the mold with an aqueous sol containing a metal oxide, and subsequently evaporating off the water phase preferably by the application of heat.

In a particularly advantageous application of the process the work face of the mold is heated to a temperature of at least 60° C. and then sprayed with or immersed in the aqueous sol, whereby these stages can be repreated several times. The density of the coating can be varied widely via the concentration of the aqueous sol, the spray time, and the number of immersion and drying cycles.

The protective layers deposited by this method on the work face of the mold have a density of around 0.2 g/cm$^3$ which, for a mass of 0.002–2 mg/cm$^2$ of work face, provides a layer which is 0.1–100 $\mu$m thick.

The protective layer of sub-micron metal oxide particles exhibits adequate adhesion to the mold face throughout casting. Particles on the surface of the cast product or on the mold face can be readily removed after casting by means of compressed air or water jetting.

The coating of sub-micron metal oxide particles is suitable for all kinds of molds either smooth or roughened.

In the case of stationary molds such as in die casting molds and molds for casting pigs, after each cast the still hot work face of the mold, if desired after the removal of the worn layer, is usefully sprayed with the aqueous sol by jetting with compressed air or water.

The coating of the work face of continuous casting molds with continuously moving mold walls which have their work faces cooled by jetting directly with water can be carried out very simply by adding an aqueous sol of metal oxide to the cooling water.

Preferred, commercially obtainable silica sols which generally have a $SiO_2$ content of around 10–30 wt.-% and if desired up to approximately 1.5 wt.% $Al_2O_3$ can be diluted freely with water according to the thickness of coating wanted.

Further advantages, features and details of the invention are revealed in the following description of results from trials.

Spraying trials in which a 0.1% silica sol was sprayed onto a copper plate heated to about 100° C. showed that a coating of 0.005 mg $SiO_2$/cm$^2$ is obtained after spraying for only 3 seconds. To obtain a coating of 0.2 mg $SiO_2$/cm$^2$ using a 1% silica sol, it was necessary to spray for 15 seconds.

After heating copper plates to about 100° C., they were sprayed for different lengths of time with a 1% silica sol; this way it was possible to produce coatings of 0.002–2 mg $SiO_2$/cm$^2$ on the copper plates.

Aluminum melts, at a temperature of 680° C., were poured onto the coated copper plates. After the solidified metal had cooled, the dendrite arm spacing in the metal structure was measured. From this it was seen that already a coating of 0.002 mg $SiO_2$/cm$^2$ of copper plate surface led to a considerable increase in the dendrite arm spacing compared with an uncoated plate which is to be attributed to the excellent thermal insulation provided by the protective layer of $SiO_2$ particles.

After pouring aluminum repeatedly onto the coated surface, a gradual removal of the coating was observed due to $SiO_2$ particles adhering to the solidified metal.

What is claimed is:

1. A mold for casting metal wherein said mold has a work face and a thermally insulating protective coating on said work face, wherein said protective coating consists essentially of sub-micron ceramin metal oxide particles having a particle size of 5–50 nm.

2. Mold according to claim 1 wherein the protective coating of metal oxide particles has a mass of 0.002–2 $mg/cm^2$ of the mold work face.

3. Mold according to claim 2 wherein said protective coating has a density of about 0.2 $g/cm^3$.

4. Mold according to claim 3 wherein said protective coating has a thickness from 0.0001 to 0.1 mm.

5. Mold according to claim 1 wherein said particles are selected from the group consisting of $SiO_2$, $Al_2O_3$, MgO, $TiO_2$ and $ZrO_2$.

6. Mold according to claim 5 wherein the protective coating is made up essentially of sub-micron $SiO_2$ particles.

7. Mold according to claim 1 wherein a plurality of layers of said protective coating are provided.

8. Mold according to claim 1 wherein the protective coating is made up essentially of sub-micron $Al_2O_3$ particles.

9. Process for coating the work face of a mold with a thermally insulating protective coating which comprises: providing a mold having a work face, wetting the said work face with an aqueous sol containing essentially sub-micron ceramin metal oxide particles having a particle size of 5–50 nm, and subsequently substantially evaporating away the water phase.

10. Process according to claim 9 wherein the mold work face is heated to a temperature of at least 60° C. and sprayed with the aqueous sol.

11. Process according to claim 9 wherein the work face of the mold is heated to a temperature of at least 60° C. and immersed in the aqueous sol.

12. Process according to claim 9 wherein said particles are selected from the group consisting of $SiO_2$, $Al_2O_3$, MgO, $TiO_2$ and $ZrO_2$.

13. Process according to claim 12 wherein the protective coating is made up essentially of sub-micron $SiO_2$ particles.

14. Process according to claim 9 wherein the protective coating of metal oxide particles has a mass of 0.002–2 $mg/cm^2$ of the mold work face.

15. Process according to claim 14 including the step of coating said mold with a protective coating having a density of about 0.2 $g/cm^3$.

16. Process according to claim 15 including the step of coating said mold with a protective coating having a thickness from 0.0001 to 0.1 mm.

17. Process according to claim 9 including the step of coating said mold with a plurality of layers of said protective coating.

* * * * *